US009423809B2

(12) United States Patent
Pons et al.

(10) Patent No.: US 9,423,809 B2
(45) Date of Patent: Aug. 23, 2016

(54) LDO REGULATOR HAVING VARIABLE GAIN DEPENDING ON AUTOMATICALLY DETECTED OUTPUT CAPACITANCE

(71) Applicant: ST-Ericsson SA, Plan-les-Ouates (CH)

(72) Inventors: Alexandre Pons, Vizille (FR); Frédéric Lebon, Grenoble (FR)

(73) Assignee: ST-Ericsson SA, Plan-les-Ouates (CH)

( * ) Notice: Subject to any disclaimer, the term of this patent is extended or adjusted under 35 U.S.C. 154(b) by 142 days.

(21) Appl. No.: 14/350,253

(22) PCT Filed: Sep. 27, 2012

(86) PCT No.: PCT/EP2012/069070
§ 371 (c)(1),
(2) Date: Apr. 7, 2014

(87) PCT Pub. No.: WO2013/050291
PCT Pub. Date: Apr. 11, 2013

(65) Prior Publication Data
US 2014/0247028 A1 Sep. 4, 2014

Related U.S. Application Data

(60) Provisional application No. 61/554,701, filed on Nov. 2, 2011.

(30) Foreign Application Priority Data

Oct. 6, 2011 (EP) ..... 11306300

(51) Int. Cl.
*G05F 1/575* (2006.01)
*G05F 1/10* (2006.01)

(52) U.S. Cl.
CPC .. *G05F 1/575* (2013.01); *G05F 1/10* (2013.01)

(58) Field of Classification Search
CPC ..... G05F 1/575; G05F 1/56; G05F 1/461; G05F 1/10; G05F 1/565; G05F 1/40; G05F 1/44; H02M 3/156
See application file for complete search history.

(56) References Cited

U.S. PATENT DOCUMENTS 6,005,376 A * 12/1999 Mett ..... G05F 1/46 323/275
6,246,221 B1 6/2001 Xi
6,759,836 B1 * 7/2004 Black, Jr. ..... G05F 1/575 323/284
2006/0208802 A1 * 9/2006 Minichshofer ..... H03F 1/302 330/289
2009/0237048 A1 * 9/2009 Hou ..... G05F 1/575 323/282
2013/0069608 A1 * 3/2013 Gakhar ..... G05F 1/575 323/273

FOREIGN PATENT DOCUMENTS

CN 101546205 B 5/2011
EP 1530289 A1 5/2005
WO 2007149632 A2 12/2007

* cited by examiner

*Primary Examiner* — Fred E Finch, III
*Assistant Examiner* — Gustavo Rosario Benitez
(74) *Attorney, Agent, or Firm* — Coats & Bennett, PLLC

(57) ABSTRACT

The present invention concerns a low dropout (LDO) regulator of regulating an output signal, the LDO regulator comprising an input stage (15) and an output stage (17), the input stage being adapted to receive a reference signal ($V_{REF}$) and a feed-back signal ($V_F$) depending on an output signal ($V_{OUT}$), and to output an intermediate signal based on the feedback signal and on the reference signal, wherein the LDO regulator further comprises a gain stage (16) having a given gain value, which is configurable and wherein the output signal is regulated based on the gain value of the gain stage and on the intermediate signal.

7 Claims, 6 Drawing Sheets

LDO REGULATOR HAVING VARIABLE GAIN DEPENDING ON AUTOMATICALLY DETECTED OUTPUT CAPACITANCE

BACKGROUND OF THE INVENTION

1. Technical Field

The present invention generally relates to Low Drop Out (LDO) voltage regulators.

It finds applications, in particular, in batteries or any equipment that needs constant and stable voltage supply such as mobile phones, cordless extension phones, MP3 players.

2. Related Art

Voltage regulators are usually used to provide a stable power supply voltage independent of load impedance, input-voltage variations, temperature and time. An output capacitor is generally used to stabilize the voltage regulator and to filter perturbations due to load transients.

In some cases, output capacitors have to be changed to allow a better flexibility. For example, if the output load is quiet, a small capacitance (for example 100 nanofarads nF) can be used. On the contrary, if the output load is noisy, a high capacitance (for example 2.2 microfarads uF) would be more adapted.

However, while changing the output capacitor, the system comprising the voltage regulator and the output capacitor can become unstable with a risk of degrading the output component. Indeed, in prior art systems, each couple of output current and output capacitor needs a dedicated LDO driver for stability reasons and it is not possible to change "on demand" the value of the output capacitor.

Referring to FIG. 1, there is shown a LDO regulator according to the prior art. The LDO regulator comprises a differential stage 101, a buffer stage 102, a PMOS transistor 103, an output impedance 104, which is supplied with an output voltage $V_{OUT}$, and a feedback circuit 105. Based on the output voltage $V_{OUT}$, the feedback circuit 105 is adapted to generate a feedback voltage $V_{F1}$ to be transmitted to the differential stage 101. The differential stage 101 is adapted to generate an intermediate signal that is forwarded to the buffer stage 102, which has a unity gain, based on the feedback voltage $V_{F1}$ and based on a reference voltage $V_{REF1}$. The buffer stage 102 controls the gate of the PMOS transistor 103, which source is supplied by a high positive supply voltage $V_{DD}$ and which drain is connected to the output of the LDO regulator. The output impedance $Z_{OUT}$ 104, which is at the output of the LDO regulator, can be constituted of an output capacitor in parallel with a circuit, which is supplied by the regulator with an output voltage $V_{OUT}$. Depending on the output load, it can be advantageous to change the output capacitor.

Referring to FIG. 2, there is shown a Bode diagram in open loop in a system of the prior art, such as the LDO regulator shown on FIG. 1, representing phase and gain in decibels (dB) versus frequency in Hertz (Hz), for different values of output capacitors. Curves 1.1, 1.2, 1.3 and 1.4 respectively represent phase versus frequency with an AC test signal at an inverting input $V_F$ (which will be further detailed referring to FIG. 2) and curves 2.1, 2.2, 2.3 and 2.4 respectively represent gain versus frequency, for the following capacitance values of output capacitors: 2.2 uF; 1 uF; 0.47 uF and 100 nF.

As it can be observed on FIG. 2, when the capacitance value of the output capacitor decreases, frequency of the dominant pole (in the gain curves) 4.1, 4.2, 4.3 and 4.4 is shifted toward higher frequencies. The phase margins, meaning the phase values observed when the gain is equal to zero, are correspondingly reduced. For example, for an output capacitor value equal to 0.47 uF, phase margin 3.3 is approximately equal to 33 degrees, which is stable but low (meaning that transient response is not enough damped), whereas for an output capacitor value equal to 100 nF, phase margin 3.1 is around zero. It is noted that in order to remain stable, phase margins should be held around 45 degrees. Thus, decreasing the output capacitor value from 0.47 uF to 100 nF means that the system of the prior art becomes really unstable.

Other factors contribute to instability of the system, such as the current consumption of the LDO voltage regulator for example.

Thus there is a need to design a LDO regulator that remains robust and stable while an internal or external factor is varying (such as an output capacitance value or the current consumption).

SUMMARY OF THE INVENTION

To address these needs, a first aspect of the present invention relates to a low dropout (LDO) regulator for regulating an output signal, the LDO regulator comprising an input stage and an output stage, the differential input stage being adapted to receive a reference signal and a feedback signal depending on an output signal (for example a fraction of the output signal), and to output an intermediate signal based on the feedback signal and the reference signal, the LDO regulator further comprising a gain stage having a given gain value, which is configurable and the output signal being regulated based on the gain value of the gain stage and on the intermediate signal.

Thus, the invention enables to add a gain stage in a LDO regulator, for which a gain value is adjustable. Indeed, the gain stage enables increasing the phase margin by keeping the dominant pole at a fixed frequency and by reducing the unity gain frequency, thus enabling the LDO regulator to be configurable while external or internal factors are varying.

According to some embodiments of the invention, the output stage is adapted to be connected to an output capacitor having a capacitance value and the gain value is configured based on the capacitance value of the output capacitor.

Thus, the LDO regulator can adjust the gain value of the gain stage based on the capacitance value of an output capacitor and it can remain stable while changing the output capacitor for example.

In complement, upon replacement of the output capacitor connected to the output stage by a new output capacitor having a new capacitance value, which differs from the capacitance value of the output capacitor, the gain of the gain stage is reconfigured based on the new capacitance value.

These embodiments enable to change the output capacitors on the fly, while maintaining the stability of the LDO regulator.

In complement or in variant, the LDO regulator further comprises means to measure charging time of the output capacitor and means to compare the charging time with predefined time windows to determine the capacitance value of the output capacitor.

Thus, the LDO regulator can be configured without the use of an external system. It detects itself a capacitance value of the output capacitor and adapt the gain value of the gain stage accordingly to maintain sufficient phase margin.

According to some embodiments, the gain stage comprises a potentiometer to vary the gain value.

These embodiments enable to control the gain value of the gain stage with a potentiometer, which allows selecting a large range of gain values.

Alternatively or in complement, the gain stage comprises one first resistor or a plurality of first resistors, each of said first resistor or resistors being in series with an associated switch, wherein the gain stage further comprises a second resistor, and wherein the gain value is configured by opening or closing the switch or switches respectively associated with the first resistor or resistors. These embodiments provide a low cost solution to adapt the gain. Indeed, by controlling the switches, the gain (and thus the open loop gain of the LDO regulator) can be adapted depending on external or internal factors.

A second aspect of the invention relates to a system for regulating an output signal. The system comprises an output capacitor having a capacitance value and a low dropout (LDO) regulator comprising an input stage and an output stage, the differential input stage being adapted to receive a reference signal and a feedback signal depending on an output signal (a fraction of the output signal for example), and to output an intermediate signal based on the feedback signal and on the reference signal, the output stage being adapted to be connected to the output capacitor, the LDO regulator further comprises a gain stage having a given gain value, which is configurable based on the capacitance value of the output capacitor and the output signal is regulated based on the gain value of the gain stage and on the intermediate signal.

A third aspect of the invention concerns a method of regulating an output signal, the method being implemented by a LDO regulator comprising a differential input stage and an output stage, the method comprising:

- receiving a reference signal and a feedback signal depending on the output signal at the input stage;
- outputting an intermediate signal based on the feedback signal and on the reference signal.

The method further comprises:

- configuring a given gain value of a gain stage of the LDO regulator;
- regulating the output signal based on the gain value of the gain stage and on the intermediate signal.

In some embodiments, the output stage is adapted to be connected to an output capacitor having a capacitance value and the gain value is configured based on the capacitance value of the output capacitor.

In complement, the method further comprises measuring charging time of the output capacitor and comparing the charging time with predefined time windows to determine the capacitance value of the output capacitor.

Alternatively or in complement, upon replacement of the output capacitor connected to the output stage by a new output capacitor having a new capacitance value, which differs from the capacitance value of the output capacitor, the method comprises reconfiguring the gain of the gain stage based on the new capacitance value.

BRIEF DESCRIPTION OF THE DRAWINGS

The present invention is illustrated by way of example, and not by way of limitation, in the figures of the accompanying drawings, in which like reference numerals refer to similar elements and in which.

DESCRIPTION OF PREFERRED EMBODIMENTS

In what follows, a configurable LDO regulator is introduced, for which the open loop gain is adapted to a capacitance value of an output capacitor. However, a similar architecture can be applied to adapt the open loop gain of the LDO regulator to any other internal or external factor, such as the current consumption of the LDO regulator for example. Indeed, power supply rejection depends on the gain value. The gain value has to be adapted to load/line transient specifications because it impacts the transient response of the LDO. Thus, the present invention is not limited to the following embodiments, which are given for the sake of better understanding.

Figure 3:
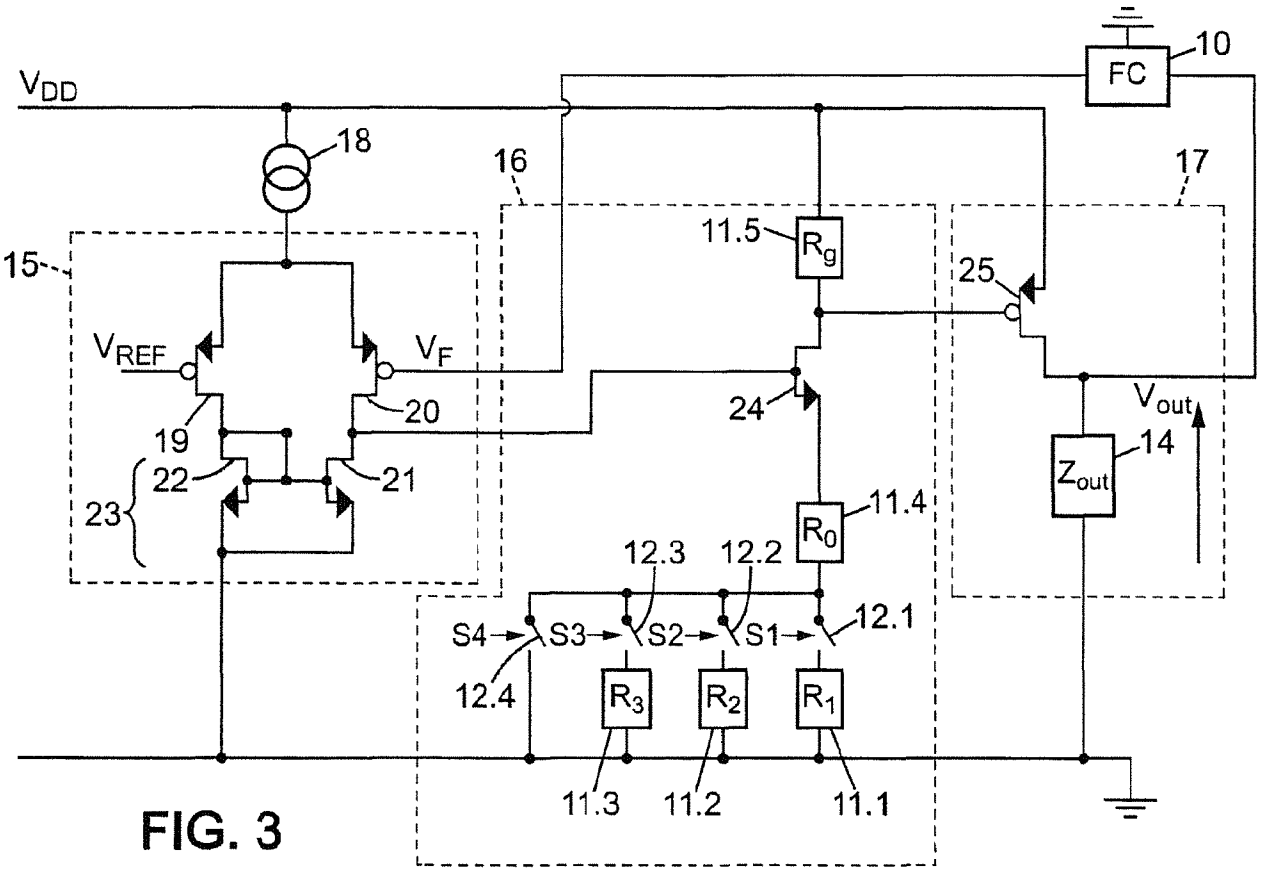
FIG. 3 illustrates a LDO regulator according to some embodiments of the invention.

Referring to FIG. 3, there is shown a LDO voltage regulator according to some embodiments of the invention.

The LDO voltage regulator comprises a differential input stage 15, a gain stage 16 and an output stage 17.

The differential input stage 15 is adapted to receive a reference voltage $V_{REF}$ on a gate of a first PMOS transistor 19 and a feedback voltage $V_F$ on a gate of a second PMOS transistor 20. A feedback circuit 10 is adapted to generate the feedback voltage $V_F$ based on the output voltage $V_{OUT}$ of the LDO regulator. For example, the feedback voltage $V_F$ can be a fraction of the output voltage $V_{OUT}$. Voltage $V_{REF}$ is stable and has a constant value. Both first and second transistors 19 and 20 sources are forming a differential pair (which can be a NMOS, cascaded or folded) and are supplied by a current source 18. Their respective drains are also connected to an active load 23 (comprising a first NMOS transistor 22 and a second NMOS transistor 21), which is connected to the differential pair 20.

An output of the differential input stage 15 located between the second PMOS transistor 20 drain and the second NMOS transistor 21 drain is connected to a gate of a third NMOS transistor 24 of the gain stage 16.

Because of the active load 23, the same current is flowing through the branch comprising the first PMOS transistor 19 and through the branch comprising the second PMOS transistor 20 when the reference voltage $V_{REF}$ is equal to the feedback voltage $V_F$.

When the reference voltage $V_{REF}$ is greater than the feedback voltage $V_F$, more current is flowing through the branch comprising the second PMOS transistor 20 than through the first PMOS transistor 19. As the same current is flowing through the branch comprising the first NMOS transistor 22 and through the branch comprising the second NMOS transistor 21, the voltage at the gate of the third NMOS transistor 24 is increased.

When the reference voltage $V_{REF}$ is lower than the feedback voltage $V_F$, more current is flowing through the branch comprising the first PMOS transistor 19 than through the second PMOS transistor 20. As the same current is flowing through the branch comprising the first NMOS transistor 22 and through the branch comprising the second NMOS transistor 21, the voltage at the gate of the third NMOS transistor 24 is decreased.

Such architecture of the differential input stage is given as an example and does not restrict the scope of the invention, which can be implemented in LDO regulators comprising other input stage architectures.

The gain stage 16 comprises a first resistor 11.4 connected to the source of the third NMOS 24. The first resistor 11.4 has a resistance value $R_0$ is also connected to a second resistor 11.1 having a resistance value $R_1$, a third resistor 11.2 having a resistance value $R_2$ and a fourth resistor 11.3 having a resistance value $R_3$, that are connected in parallel. For example, $R_1$ can be less than $R_2$, which can be less than $R_3$.

The gain stage 16 comprises a first switch 12.4 in parallel with resistors 11.1, 11.2 and 11.3, a second switch 12.1 in series with the second resistor 11.1, a third switch 12.2 in series with the third resistor 11.2 and a fourth switch 12.3 in series with the fourth resistor 11.3.

The gain stage 16 further comprises a fifth resistor 11.5 having a fifth resistance value $R_g$ and which is connected between the drain of the third NMOS transistor 23 and a high positive supply voltage $V_{DD}$.

The output of the gain stage 16 connects the drain of the third NMOS transistor 24 to a gate of a third PMOS transistor 25 of the output stage.

The output stage 17 further comprises an impedance $Z_{OUT}$ 14, which can be constituted of an output capacitor in parallel with a circuit which is supplied by the regulator with an output voltage $V_{OUT}$. The fifth resistor 11.5, the source of the third PMOS transistor 25 and the current source 18 are supplied with a high positive supply voltage $V_{DD}$.

It is noted that $V_F$ is a feedback voltage and that consequently $V_{OUT}$ and $V_F$ vary in a similar way. Thus, when $V_{OUT}$ is decreasing, there is an imbalance between voltages $V_{REF}$ and $V_F$. Consequently, more current is flowing through the branch comprising the second PMOS transistor 20 and thus, there is an increase of the voltage at the gate of the third NMOS transistor 24 which is connected to the output of the differential input stage 15. Therefore, more current is flowing from the source to the drain of the third NMOS transistor 24, the voltage at the gate of the PMOS transistor 25 is decreasing and more current arrives on the drain of the third PMOS transistor 25, thus increasing the output voltage $V_{OUT}$, which is compensated. In a similar way, when $V_{OUT}$ is increasing, the LDO regulator enables to decrease the output voltage $V_{OUT}$, which is then compensated.

As explained in the related art section, it can be advantageous to decrease the output capacitance value when the output load is quiet and to increase it when the output load is noisy. However, while decreasing the capacitance value, the phase margins are reduced and the LDO voltage regulator can become unstable. The present invention proposes to decrease the open loop gain while the capacitance value is decreasing to maintain a sufficient phase margin.

Figure 5:
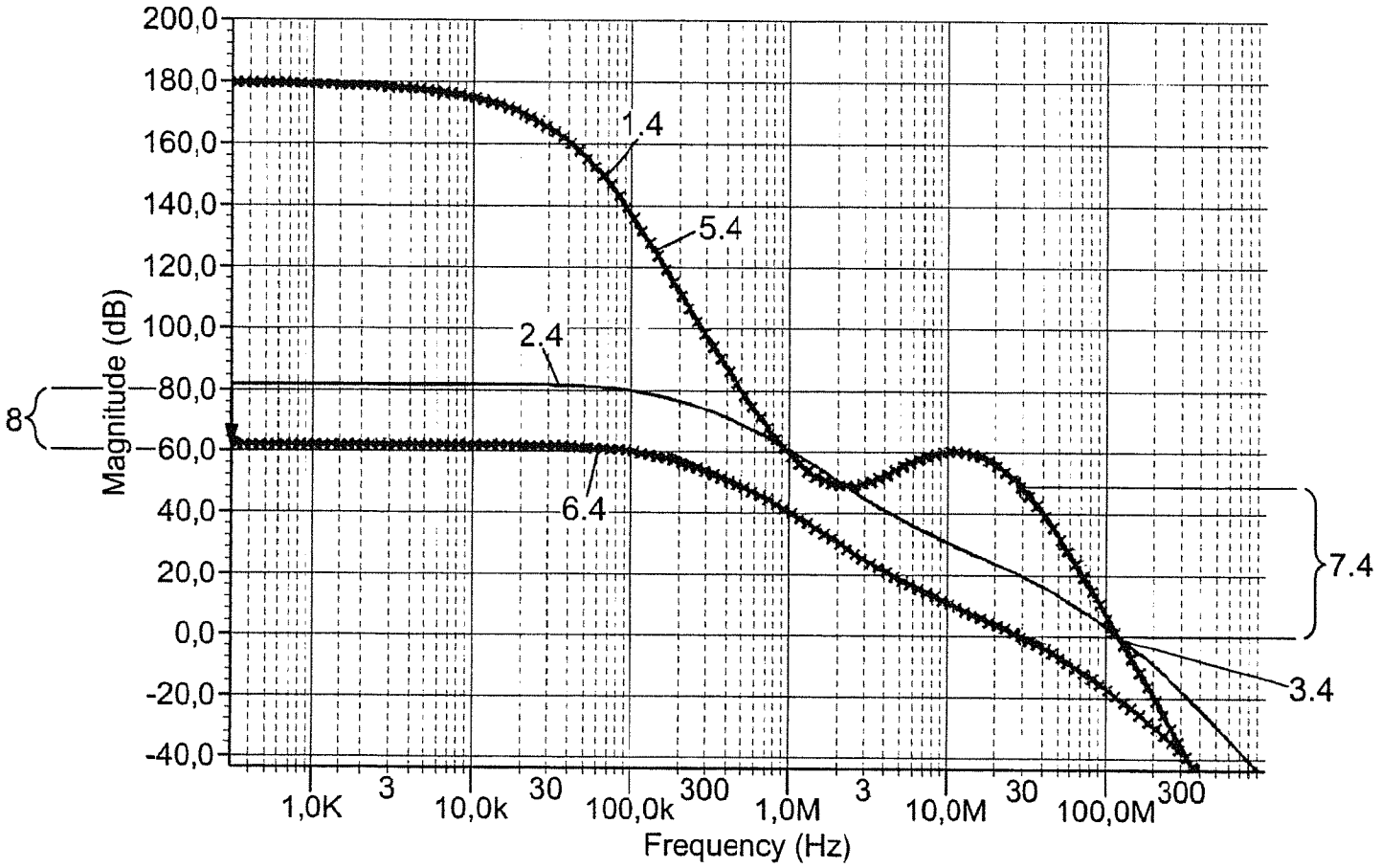
FIG. 5 illustrates a comparison between a Bode diagram in open loop in a system of the prior art and a Bode diagram in open loop in a LDO regulator according to some embodiments of the invention, representing phase and gain in decibels versus frequency in Hertz, for different values of output capacitors.

Indeed, referring now to FIG. 5, there is shown a superposition of a Bode diagram in open loop in a system of the prior art with a Bode diagram in open loop of a LDO regulator according to the invention (as illustrated on FIG. 3 for example), representing phase and gain in decibels (dB) versus frequency in Hertz (Hz) for an output capacitor value equal to 100 nF. Curves 1.4 and 2.4 are respectively the phase and gain curves for an output capacitance value equal to 100 nF as illustrated on FIG. 2, in a system of the prior art. The phase margin is about zero as mentioned above which is not sufficient to ensure stability.

In the LDO voltage regulator according to some embodiments of the invention, curves 5.4 and 6.4 represent respectively phase and gain versus frequency. As it can be seen, adding the gain stage 16 does not affect the phase curve 5.4 but translates the gain curve 6.4 by a translation value 8 which equals −20 dB in this example. By decreasing the open loop gain, sufficient phase margin is obtained to enable stability of the regulator for an output capacitance value equal to 100 nF. Indeed, when the gain equals zero, the phase margin approximately equals 50 degrees.

Figure 1:
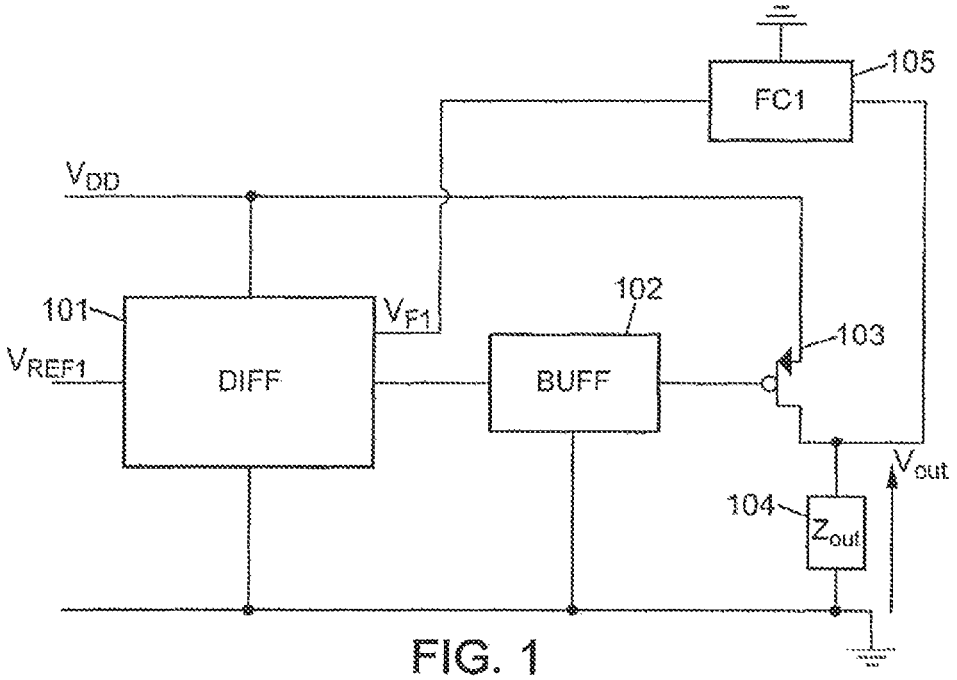
FIG. 1 (Prior Art)
FIG. 1 represents a LDO regulator according to the prior art.
Figure 2:
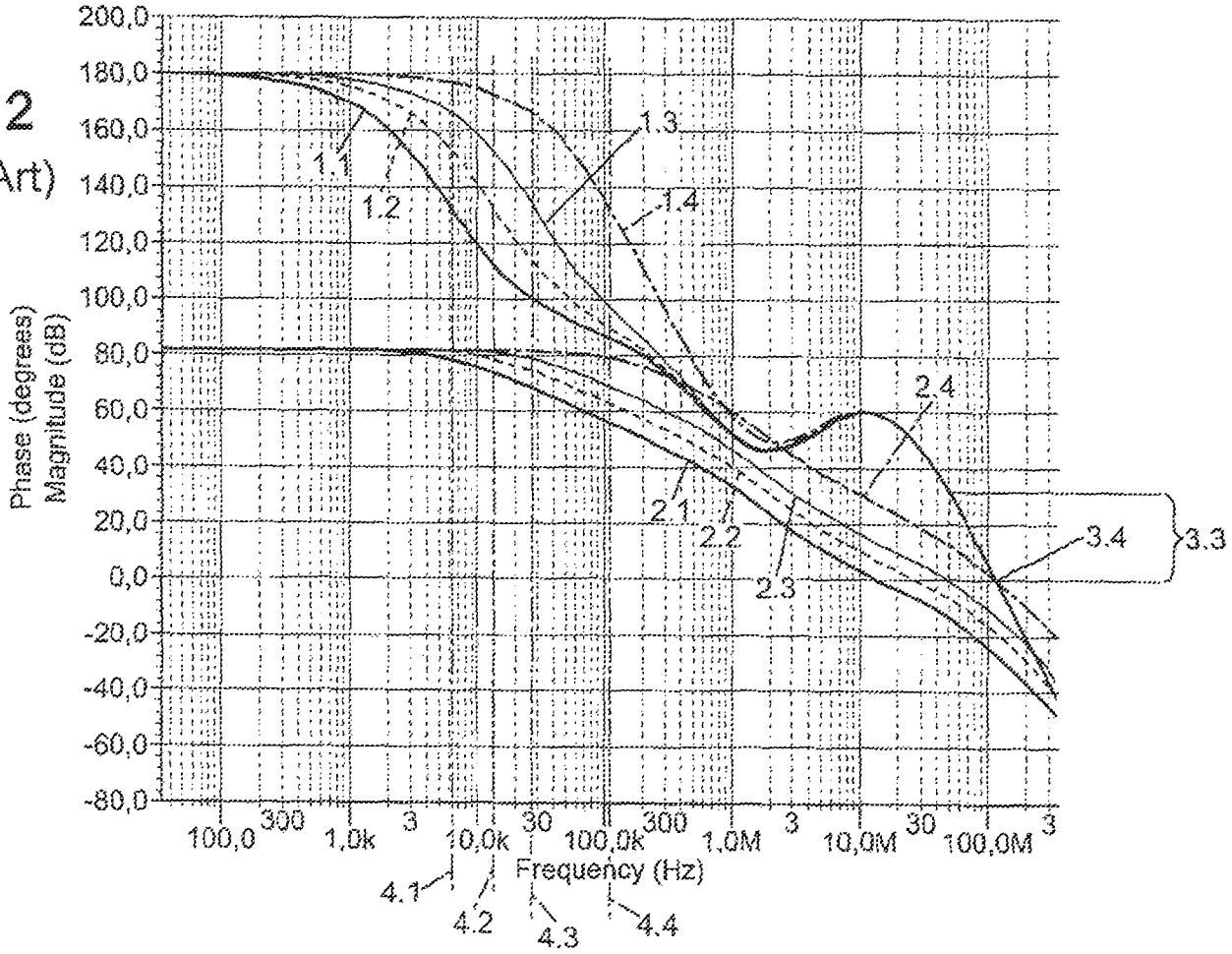
FIG. 2 (Prior Art)
FIG. 2 represents a Bode diagram in open loop in a system of the prior art, representing phase and gain in decibels versus frequency in Hertz, for different values of output capacitors.

For higher output capacitance values (e.g. 0.47 uF and 1 uF), the translation value 8 can be reduced as the original phase margin is larger, as can be seen on FIG. 2. Thus, some embodiments of the invention propose to decrease a DC open loop gain in a LDO voltage regulator when the output capacitance value is decreased.

Referring to FIG. 3 again, a DC open loop gain of the LDO voltage regulator can be written as:

$$G=G_{diff}*G_{cs}*G_{out}$$

where $G_{diff}$ is the gain of the differential input stage 15, $G_{cs}$ is the gain of the gain stage 16, and $G_{out}$ is the gain of the output stage 17.

$G_{cs}$ is approximately equal to $R_g/R_s$ where $R_s$ is the total resistance value at the source of the third NMOS 24.

$R_s$ can be adjusted depending on the capacitance value of the capacitor at the output stage 17 by using the switches 12.1, 12.2, 12.3 and 12.4. To this end, a detection circuit 26 is adapted to close or open the switches depending on the capacitance value, after having determined it. The determination of the capacitance value will be further detailed with reference to FIGS. 4 and 6. When the capacitance value is determined, the detection circuit 26 generates a digital code which enables/disables required switches 12.1, 12.2, 12.3 and 12.4 to modify the gain $G_{cs}$ and thus the DC open loop gain depending on the capacitance value, as it will be explained with reference to FIGS. 4 and 6.

In the implementation represented on FIG. 3, $G_{cs}$ can take four different values:

- $G_{cs1}=R_g/R_0$ when the switches 12.2, 12.3 and 12.1 are open and when the switch 12.4 is closed;
- $G_{cs2}=R_g/(R_0+R_1)$ when the switches 12.2, 12.3 and 12.4 are open and when the switch 12.1 is closed;
- $G_{cs3}=R_g/(R_0+R_2)$ when the switches 12.1, 12.3 and 12.4 are open and when the switch 12.2 is closed;
- $G_{cs4}=R_g/(R_0+R_3)$ when the switches 12.1, 12.2 and 12.4 are open and when the switch 12.3 is closed;

Finally, the DC open loop gain of the LDO voltage regulator is adjustable from $G1=G_{diff}*G_{cs1}*G_{out}$ to $G4=G_{diff}*G_{cs4}*G_{out}$.

However, in some other embodiments, two of the switches 12.1, 12.2 and 12.3 can be closed, 12.4 being open, or the three switches 12.1, 12.2 and 12.3 can be closed, 12.4 being open, thus offering new gain $G_{cs}$ possibilities.

In some other embodiments, the resistors 11.1, 11.2, 11.3 and 11.4 can be replaced by a potentiometer, which can also be controlled by the detection circuit 26 to adjust the gain $G_{cs}$ and thus the DC open loop gain.

In addition, no restriction is attached to the number of resistors that are comprised in the gain stage 16. Indeed, the LDO regulator according to the invention can be adapted to more than four output capacitance values by adding resistors in parallel to adjust the DC open loop gain accordingly.

If it is considered that $R_1$ is less than $R_2$, which is less than $R_3$. Then $G_{cs1}$ is greater than $G_{cs2}$, which is greater than $G_{cs3}$, which is greater than $G_{cs4}$.

Thus, the highest gain $G_{cs1}$ can be selected when the output capacitor has a capacitance value equal to 2.2 uF. The gain $G_{cs2}$ can be selected when the output capacitor has a capacitance value equal to 1 uF. The gain $G_{cs3}$ can be selected when the output capacitor has a capacitance value equal to 0.47 uF. The lowest gain $G_{cs4}$ can be selected when the output capacitor has a capacitance value equal to 100 nF. Then, the gain of the gain stage 16 is adapted to the capacitance value of the output capacitor to ensure sufficient phase margin and thus stability for a plurality of output capacitance values. It is noted that capacitance values need not be exactly equal to 2.2 uF, 1 uF, 0.47 uF and 100 nF. Indeed, the gain $G_{CS}$ can be adapted to a range of output capacitance values.

In some embodiments, the gain selection can be done outside the LDO voltage regulator by programming registers for example.

In some other embodiments, the DC open loop gain can be automatically adjustable upon detection of the capacitance value of the output capacitor. As illustrated on FIG. 6, the capacitance value can be determined based on the charging time of the output capacitor. The charging time of the output is given by $$\frac{C}{I} \times V_{OUT},$$

where C is the capacitance value of the output capacitor and I constant regulated current provided by the LDO voltage regulator during a start up phase.

Figure 4:
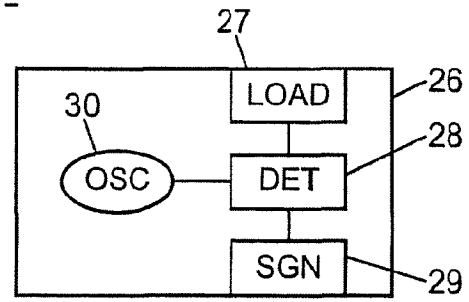
FIG. 4 illustrates a detection circuit according to some embodiments of the invention.

Referring to FIG. 4, there is shown a detection circuit 26 according to some embodiments of the invention. The detection circuit 26 comprises a detection unit 27, which is adapted to detect a charging time of the output capacitor. The detection unit is connected to a determination unit 28, which is connected to an integrated oscillator 30 of the detection circuit 26. As it will be explained with reference to FIG. 6, the determination unit 28 determines a capacitance value of the output capacitor based on comparisons between clock signals which are provided by the integrated oscillator 30 and the signal received from the detection unit 27, when the output capacitor is charged.

Based on the determined capacitance value of the output capacitance, a signalling unit 29 is adapted to control the actuators $S_1$, $S_2$, $S_3$ and $S_4$ by generating a digital code. Thus, the gain of the gain stage 16 can be controlled, and the open loop gain of the LDO regulator depending on the capacitance value of the output capacitor.

In addition, the detection circuit 26 can comprise an integrated current regulator to generate a fixed current during the output capacitor charge.

Figure 6:
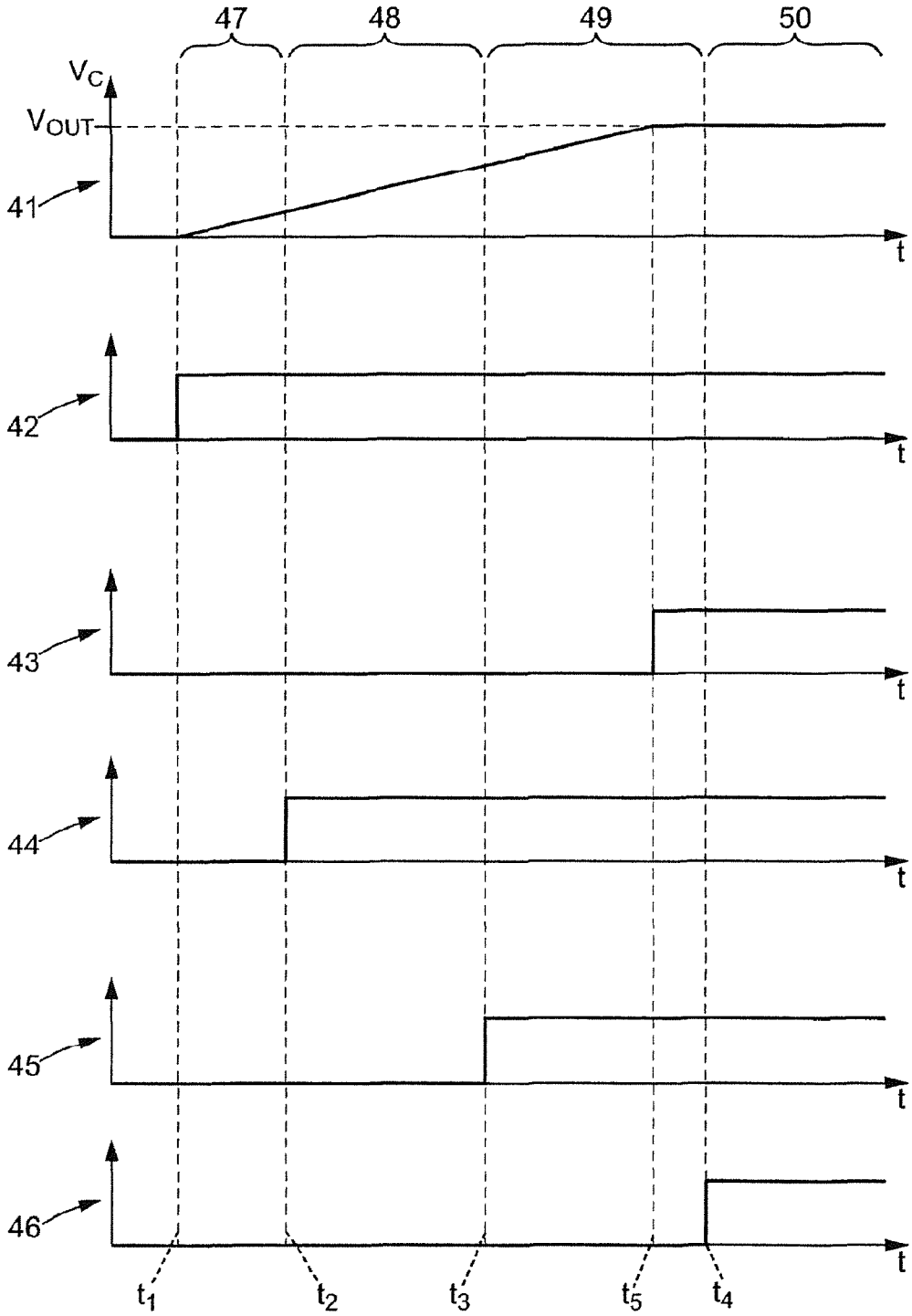
FIG. 6 represents a plurality of temporal diagrams for a determination of the output capacitance value by a comparator of a LDO regulator, according to some embodiments of the invention.

Referring to FIG. 6, there is shown a plurality of temporal diagrams for a determination of the output capacitance value by the detection circuit 26, according to some embodiments of the invention.

A first temporal diagram 41 represents the charging voltage $V_C$ of the output capacitor, which finally reaches the voltage $V_{OUT}$. The first temporal diagram is performed by the detection unit 27. When $V_{OUT}$ is reached, a signal is transmitted to the determination unit 28.

A second temporal diagram 42 represents a rising edge when the output voltage $V_{OUT}$ is obtained at the output stage 17 of the LDO voltage regulator. The rising edge is at time $t_1$. Thus, the output capacitor starts charging at time $t_1$ on the first temporal diagram 41.

A third temporal diagram 43 represents a rising edge at time $t_5$, which corresponds to the time at which the loaded voltage of the output capacitor reaches the output voltage $V_{OUT}$, and thus to the time when the signal is received from the detection unit 27.

A fourth temporal diagram 44, a fifth temporal diagram 45 and a sixth temporal diagram 46 represent rising edges at respective times $t_2$, $t_3$ and $t_4$. These rising edges can be generated by a real time clock external to the LDO voltage regulator or by an oscillator integrated to the LDO voltage regulator.

Temporal diagrams 44, 45 and 46 can be determined based on clock signals which are received by the determination unit 28 from the integrated oscillator 30 of the detection circuit 26.

A first time window 47 between times $t_1$ and $t_2$ is predefined and is associated with output capacitors, for which the capacitance value is less than 100 nF. A second time window 48 between times $t_2$ and $t_3$ is predefined and is associated with output capacitors, for which the capacitance value is comprised between 100 nF and 0.47 uF. A third time window 49 between times $t_3$ and $t_4$ is predefined and is associated with output capacitors, for which the capacitance value is comprised between 0.47 uF and 1 uF. A fourth time window 50 including times greater than $t_4$ is predefined and is associated with output capacitors, for which the capacitance value is more than 1 uF. The time windows can be predefined as the charging time of a capacitor is directly proportional to its capacitance value at the condition that the charging current is constant. In the circuit illustrated here, there is a current regulator, which provides a fixed charging current.

The detection circuit 26 illustrated on FIG. 4, and in particular the determination unit 28, is adapted to detect that the edge on the third temporal diagram 43 is rising at time $t_5$ which is comprised in the third time window 49. Then, the gain of the gain stage of the LDO voltage regulator can be consequently adapted by generating a digital code to control the actuators and thus to control the open loop gain of the LDO regulator. For example, the gain $G_{cs2}$ can be selected as it enables to obtain sufficient phase margin for output capacitors, for which the capacitance value is equal to 1 uF. As illustrated on FIG. 4, the detection circuit 26 can control the actuators S1, S2, S3 and S4 with the generated digital code. In this example, comprising four actuators, the digital code can be coded with four bits. Thus, can open the switches 12.2, 12.3 and 12.4 and close the switch 12.1 so that the gain of the gain stage 16 of the LDO voltage regulator is equal to $G_{cs2}$.

To improve the accuracy of the gain depending on the output capacitance value, more resistors can be added in parallel in the gain stage 16, thus creating a finer temporal division in time windows on FIG. 6.

Figure 7:
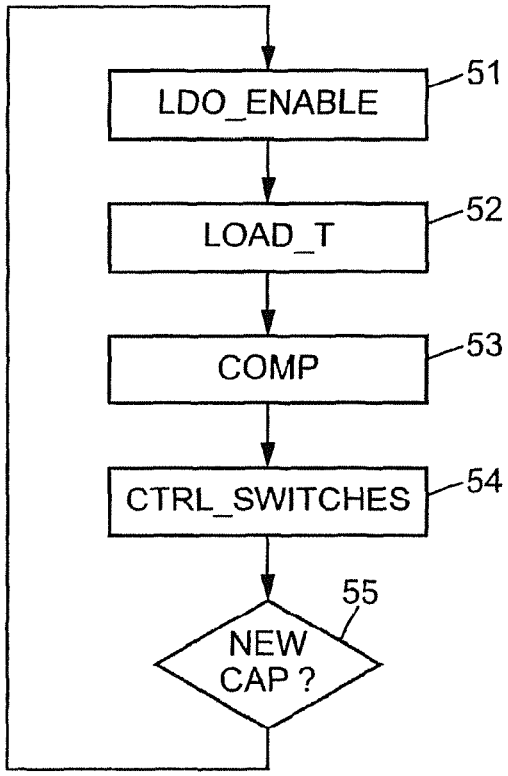
FIG. 7 illustrates a flowchart representing the steps of a method according to some embodiments of the invention.

Referring to FIG. 7, there is shown a flowchart representing the steps of a method according to some embodiments of the invention. Initially, a capacitor, for which the capacitance value has not been determined, is connected to the output stage 16 of the LDO voltage regulator according to the invention.

At a step 51, the output voltage $V_{OUT}$ is obtained at the output stage 17 of the LDO voltage regulator.

At a step 52, the voltage charged by the output capacitor reaches the value of the output voltage $V_{OUT}$. Consequently, a signal is generated upon detection of the rising edge on the third temporal diagram 43.

At a step 53, a targeted gain of the gain stage of the LDO voltage regulator is determined by the detection circuit 26 comparing the time $t_5$ at which the signal is generated with predefined time windows 47, 48, 49 and 50.

At step 54, the comparator controls the actuators S1, S2, S3 and S4 to open or close the switches so that the gain of the gain stage 16 reaches the targeted gain.

At step 55, when a new capacitor replaces the output capacitor, the previous steps are repeated to adapt the gain to the capacitance value of the new capacitor.

Thus, the invention allows an improved flexibility during a platform development as the output capacitor can be adapted versus needs. For example, if the output load is quiet, a large e.g. 1 uF capacitor can be replaced by a smaller 100 nF capacitor. Conversely, if the output load is noisy, a larger 2.2 uF capacitor can be used for better filtering.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed in be a reference to the plural and vice versa.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, some embodiments of the present invention may not include all of the features described above. Therefore, it is intended that the present invention not be limited to the particular embodiments disclosed, but that the invention include all embodiments falling within the scope of the invention as broadly defined above.

The invention claimed is:

1. A low dropout (LDO) regulator operative to regulate an output signal, said LDO regulator comprising an output stage adapted to be connected to an output capacitor having a capacitance value;

a capacitance measuring circuit operative to determine the capacitance value of the output capacitor and to indicate the capacitance value falls within one of at least two non-zero capacitance value ranges, comprising a first circuit operative to measure a charging time of the output capacitor, and a second circuit operative to compare said charging time with predefined time windows to determine the range of capacitance values into which the output capacitor falls;

an input stage adapted to receive a reference signal and a feedback signal depending on the output signal, and to output an intermediate signal based on said feedback signal and on said reference signal;

a gain stage having a configurable gain value and operative to generate one of at least two gain values based on the indicated range of capacitance value;

wherein the output signal is regulated based on the gain value of the gain stage and on the intermediate signal;

a first circuit operative to measure a charging time of the output capacitor; and a second circuit operative to compare said charging time with predefined time windows to determine the range of capacitance values into which the output capacitor falls.

2. The LDO regulator of claim 1, wherein upon replacement of a first output capacitor connected to the output stage by a second output capacitor having a capacitance value falling within a different range of capacitance values from that of the first capacitor, the gain of the gain stage is reconfigured based on the second capacitance value range.

3. The LDO regulator of claim 1, wherein the gain stage comprises a potentiometer operative to vary the gain value.

4. The LDO regulator of claim 1, wherein the gain stage comprises one or more first resistors, each of said first resistors being in series with an associated switch, wherein the gain stage further comprises a second resistor, and wherein the gain value is configured by opening or closing the switches associated with the first resistors.

5. A system for regulating an output signal, comprising:

an output capacitor having a capacitance value; and a low dropout regulator comprising a capacitance measuring circuit operative to determine the capacitance value of the output capacitor and to indicate the capacitance value falls within one of at least two non-zero capacitance value ranges, comprising a first circuit operative to measure a charging time of the output capacitor, and a second circuit operative to compare said charging time with predefined time windows to determine the range of capacitance values into which the output capacitor falls;

an input stage adapted to receive a reference signal and a feedback signal depending on the output signal, and to output an intermediate signal based on said feedback signal and on said reference signal;

an output stage adapted to be connected to said output capacitor; and a gain stage having a configurable gain value and operative to generate one of at least two gain values based on the indicated range of capacitance value of the output capacitor;

wherein the output signal is regulated based on the gain value of the gain stage and on the intermediate signal.

6. A method of regulating an output signal, implemented by a LDO regulator comprising an input stage and an output stage, the method comprising:

determining that an output capacitor has a capacitance value falling within one of at least two non-zero capacitance value ranges by measuring a charging time of the output capacitor and comparing the charging time with predefined time windows to determine the range of capacitance values into which the capacitor falls;

receiving, at the input stage, a reference signal and a feedback signal depending on the output signal;

configuring a gain value of a gain stage of the LDO regulator based on the indicated range of capacitance value of the output capacitor;

outputting an intermediate signal based on said feedback signal and on said reference signal; and regulating the output signal based on the gain value of the gain stage and on the intermediate signal.

7. The method of claim 6, further comprising:

upon replacement of a first output capacitor connected to the output stage by a second output capacitor having a capacitance value falling within a different range of capacitance values from that of the first output capacitor, reconfiguring the gain of the gain stage based on the second capacitance value range.

* * * * *